United States Patent [19]

Tsuda et al.

[11] 4,087,951

[45] May 9, 1978

[54] BINDING DEVICE FOR FASTENING THE OPENINGS OF BAGS OR THE LIKE

[76] Inventors: Kiichi Tsuda, 2-1981-50, Naka Tomigaoka, Nara City; Fumiko Tange, 39-231, Aza Takane, Oaza Okehazama, Arimatsu-cho, Midari-ku Nagoya City, both of Japan

[21] Appl. No.: 759,869

[22] Filed: Jan. 17, 1977

[30] Foreign Application Priority Data

Sep. 2, 1976 Japan ..... 51-118323

[51] Int. Cl.[2] ..... B65B 57/08

[52] U.S. Cl. ..... 53/198 A; 140/93 A

[58] Field of Search ..... 53/138 A, 198 A; 140/93 A, 93.6; 100/17, 31

[56] References Cited

U.S. PATENT DOCUMENTS 3,538,960 11/1970 Tetrick ..... 53/138 A 3,729,896 5/1973 Lehmann ..... 53/198 A 3,825,039 7/1974 Crabb ..... 53/138 A

*Primary Examiner*—Othell M. Simpson

*Assistant Examiner*—John Sipos

*Attorney, Agent, or Firm*—Wenderoth, Lind & Ponack

[57] ABSTRACT

A binding device for fastening the openings of bags or the like which is very useful, easy to operate, and simple in structure. The device has a binding cord supplying device fitted between a pair of vertical side walls, and a binding cord delivery device having a cutting blade and delivery rollers is attached to the upper portions of these side walls. Guide slots for receiving the openings of bags are defined in the side walls and are provided with obliquely cranked slots, and a binding cord twisting mechanism attached to a slider is positioned near the cranked slots. The binding cord of a certain length is fitted to the opening of a bag and twisting both end portions of the binding cord are twisted by the rotation of the twisting mechanism.

3 Claims, 7 Drawing Figures

BINDING DEVICE FOR FASTENING THE OPENINGS OF BAGS OR THE LIKE

BACKGROUND OF THE INVENTION

This invention relates to a binding device for fastening the openings of bags or the like. More particularly, the invention relates to a binding device which is used for bundling the open end portions of bags made of paper, plastic films, regenerated cellulose films, metal foils and so forth by winding and twisting ribbon-like binding cords.

A large variety of goods such as bread, vegetables and other granular or lumpy materials are hitherto put into bags made of several materials and the open end portions of the bags are fastened by using ribbon-like wired cords, in which the cords are applied around the open ends of bags and then twisted together. In the conventional machines for attaining this purpose, the mechanisms are complicated, and erroneous actions and troubles are often caused to occur. In addition, the machines are somewhat large in size and require much floor space. These machines are, therefore not satisfactory and not easily employed in small factories. Accordingly, a handy binding device which is portable and simple in structure is desired.

BRIEF SUMMARY OF THE INVENTION

It is, therefore, the object of the present invention to provide a novel and improved binding device for fastening the openings of bags or the like, which device is able to bundle rapidly and tightly using commercially available wired cords.

Another object of the present invention is to provide a binding device of the type described which is compact and simple enough in structure to be used easily and in various kinds of work.

A further object of the present invention is to provide a binding device which can be easily produced at low cost and is durable for severe and long term use.

Pursuant to the above objects, the present invention proposes a new binding device for fastening the openings of bags or the like. The invention positions a binding cord delivery device for feeding the binding cord of a certain length and a binding cord twisting mechanism in a space between a pair of vertical side walls. By so positioning the delivery device and the twisting mechanism, the binding device of the invention is made compact, and operates easily and attains firm binding.

BRIEF DESCRIPTION OF THE DRAWINGS

In order that the invention may be more fully understood, a preferred embodiment and various supplementary features will now be described with reference to the accompanying drawings, in which.

DESCRIPTION OF THE PREFERRED EMBODIMENT

Referring now to the accompanying drawings, the embodiment of the present invention will be described in detail.

Figure 1:
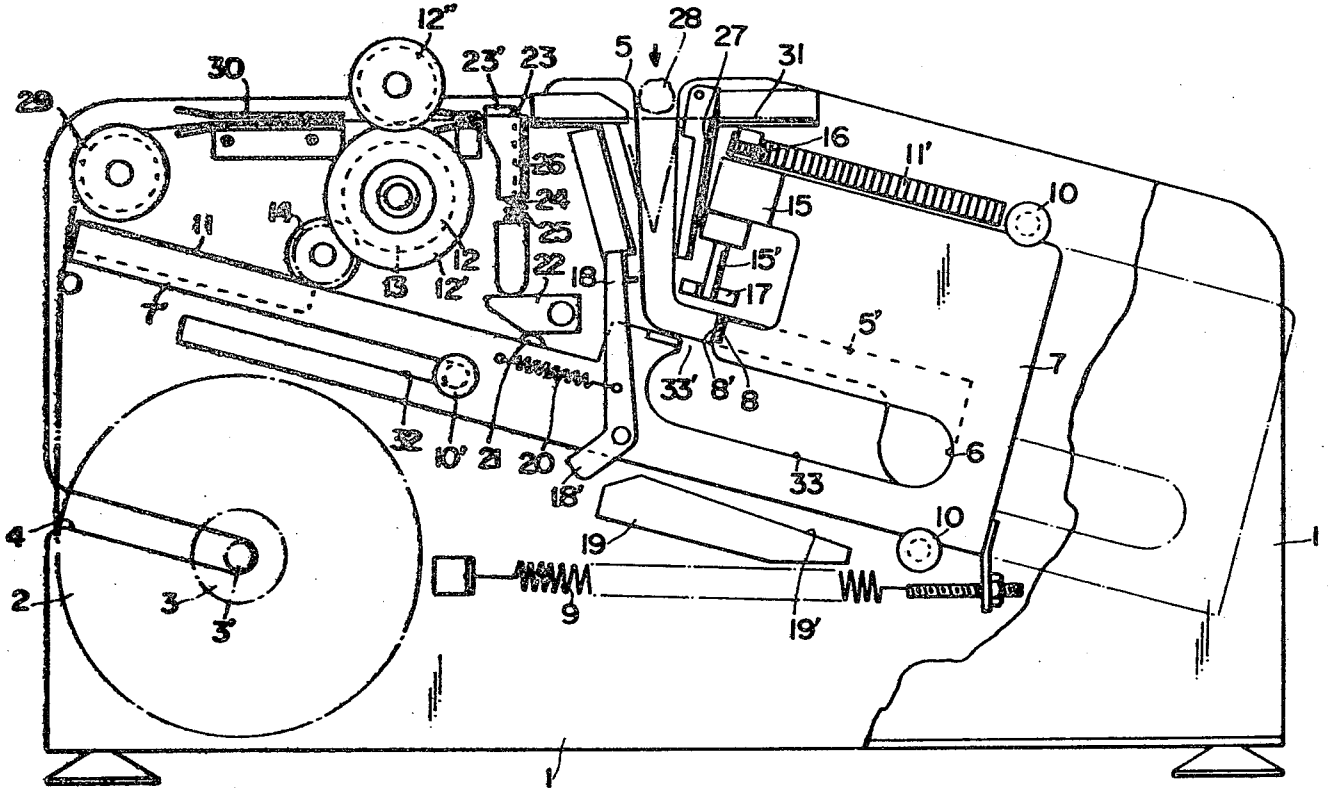
FIG. 1 is a partially cutaway side view of an embodiment of the present invention.
Figure 2:
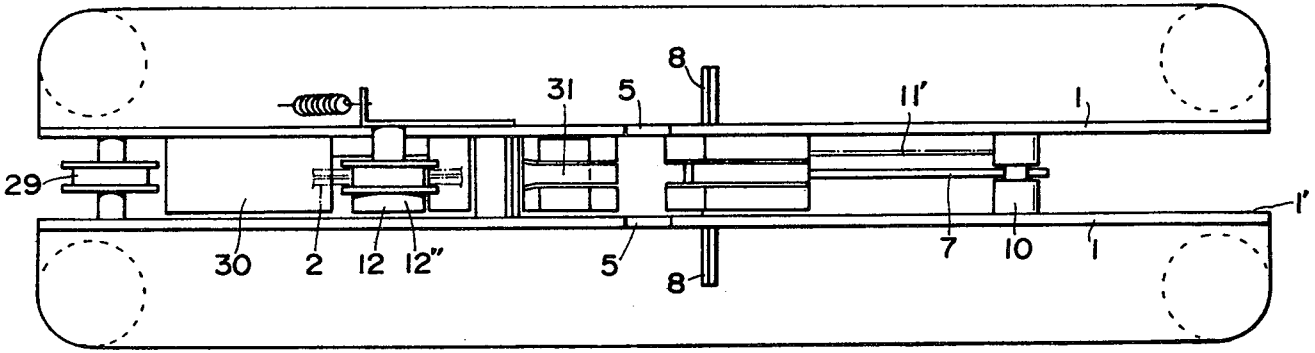
FIG. 2 is a plan view of the embodiment.
Figure 4:
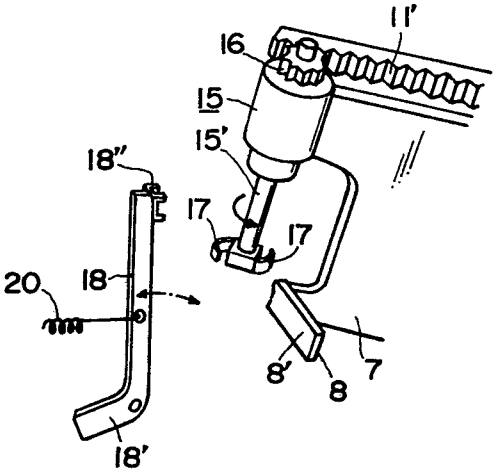
FIG. 4 is a perspective view of the main parts of a binding cord twisting mechanism.
Figure 3:
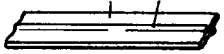
FIG. 3 is a perspective view of a binding cord.
Figure 5:
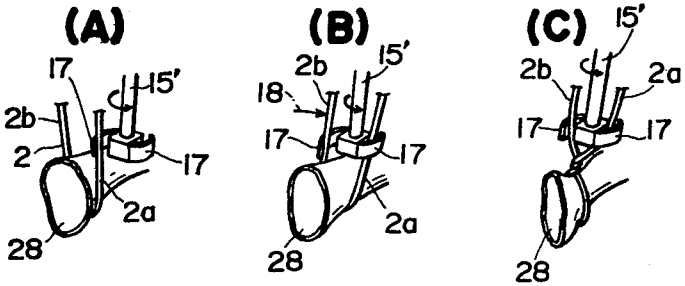
FIGS. 5 (a), 5 (b) and 5 (c) are schematic illustrations of the states of twisting of the binding cord.

As shown in FIGS. 1 and 2, a pair of right and left side walls 1 are set up in the binding device and guide grooves 4 for setting the shaft 3' of the reel 3 that carries a binding cord 2 are cut obliquely in the lower portions of the side walls 1 near one end thereof. The guide grooves 4 slope down tward the innermost ends. L-shaped guide slots 5 for receiving the open end portion of a bag are cut in the upper middle portions of the side walls 1. The innermost ends of obliquely cranked slots 5' inclined downward from the guide slots 5 have holes 6 that are serviceable for drawing out the open end portion of the bag. In the gap 1' between a pair of side walls 1, a slider 7 is fitted. The front middle portion of the slider 7 is provided with a pair of finger pieces 8 which stick out by the side walls 1 and are guided through the obliquely cranked slots 5' of the guide slots 5. To the slider 7, a spring 9 is attached, and one end thereof is fixed to a side wall 1. Further, the slider 7 is supported by guide rollers 10 on the upper and lower edges so as to freely slide parallel to the above-mentioned olbiquely cranked slots 5'. A guide arm 7' is attached to the lower front edge of the slider 7 and a feeding rack 11 is attached to the guide arm 7'. The feeding rack 11 engages with a pinion 14 that is engaged with the gear 13 of a driving roller 12' of a pair of binding cord delivery rollers 12 attached to the upper portions of the side walls 1.

A binding cord twisting mechanism 15 attached to the upper front end of the slider 7. The twisting mechanism 15 is provided with a pinion 16 that is fixed at the uppermost end of the rotating shaft 15' thereof, and this pinion 16 is brought into engagement with a stationary rack 11' on a side wall 1. To the lowermost end of the shaft 15', a pair of hooks 17 is attached for capturing the binding cord. The hooks 17 are positioned closely above the obliquely cranked slots 5'. A binding cord holding arm which is attached in front of the binding cord twisting mechanism 15 and beyond the bag-opening guide slots 5. The root end of the holding arm 18 is pivoted to the guide arm 7' of the slider 7 and the lowermost end of the holding arm 18 is provided with an engaging piece 18' which comes into engagement with a cam plate 19 formed below the slider 7 when the slider 7 is moved. The holding arm 18 is thus swung by the contact between the engaging piece 18' and the cam plate 19. The cam plate 19 is attached to a side wall 1 with a certain inclination at a position below the slider 7. As the inclination 19' is lowered toward the right (in FIG. 1), the inclination of the holding arm 18 can be gradually decreased since it is being aided by the force of a return spring 20. An action cam 21 for cutting the binding cord is formed on the upper edge of the root portion of the guide arm 7' of the slider 7, and the action cam 21 is brought into contact with a lifting cam piece 22 which is pivoted to the side wall 1 at its end portion. On the upper end of this cam piece 22 is the lower end of a lifting shaft 24 of a binding cord cutting blade 23 is placed. This cutting blade 23 moved vertically guided by a guide 26 against the force of a spring 25 that is fitted to the lifting shaft 24. The member denoted by a numeral 23' is a fixed blade that is attached to the side wall 1 and interacts with the above-mentioned cutting blade 23. V-shaped guide plates 27 for guiding the binding cord, fit on the front and rear sides of the bag-opening guide slots 5.

The operation of the binding device of the present invention is as follows. In the setting of the binding cord 2 carrying a length of wire 2', the shaft 3' of a reel 3 wound with the binding cord 2 is first inserted into the guide grooves 4 defined in the side walls 1. The binding cord 2 is pulled out and led to the guide roller 29 and is then introduced into a pair of guide plates 30 horizontally held in the upper portions of the side walls 1. The binding cord 2 is further guided to the pair of delivery rollers 12. In this state, the finger pieces 8 that project outside the side walls 1 and are integral with the slider 7 are pulled down along the obliquely cranked slots 5' of the guide slots 5 for a bag opening so as to move back the slider 7. With this movement of the slider 7, the pinion 14 in engagement with the feeding rack 11 at the end of guide arm 7' rotates and the driving roller 12' of delivery rollers 12 rotates by the engagement between its gear 13 and the pinion 14. Thus the binding cord 2 of a certain length (by a stroke of the slider) is advanced by the driving roller 12' and the opposed pushing roller 12'' and the tip end of the binding cord 2 reaches a support plate 31 passing through the inlet portion of the guide slot 5. When the finger pieces 8 are released, the slider 7 is moved upward by the force of the spring 9 to the former setting position. In this operation, the lifting cam piece 22 is pushed up by the action cam 21 formed on the guide arm 7'' and the movable lifting shaft 24 is pushed up by the lifting cam piece 22. Therefore, the cutting blade 23 is pushed out through the surface of supplied binding cord 2, thereby cutting the binding cord 2 at a certain length. The stopper mechanism of the forward movement of the slider 7 is such that a stationary guide roller 10' is received within a guide slot 32 formed in the guide arm 7' to stop up the slider 7.

When the open end portion 28 of a bag is fastened, the open end portion 28 together with the supplied binding cord 2 of a certain length are pushed down into the L-shaped guide slots 5 and moved to the right along the obliquely cranked slots 5'', thus the open end portion 28 comes into contact with the plane faces 8' of the finger pieces 8 perpendicular to the cranked slots 5'. The finger pieces 8 together with the slider 7 are retracted along the cranked slots 5' to the innermost ends thereof.

Since the pinion 16 of the rotating shaft 15' of the twisting mechanism 15 engages the stationary rack 11', when the slider 7 is moved back, the twisting mechanism 15 attached to the front edge of the slider 7 is rotated. When twisting mechanism 15 is rotated, the one half 2*a* of the binding cord 2 which has been pushed in forming a U-shape by the bag opening 28 is caught by hook 17 at the lowermost end of the twisting mechanism 15. Then, with the downward movement of the slider 7, the binding cord holding arm 18 comes into engagement with the cam plate 19 below the holding arm and the holding arm 18 is thus inclined toward the twisting mechanism 15. The remaining half 2*b* of the binding cord 2 is held by the holding frame 18'' fixed at the top end of the holding arm 18 and pushed toward the binding cord twisting mechanism 15. Meanwhile, the other hook 17 comes round and catches the cord 2*b*. In this state, when the bag opening 28 is moved further through the obliquely cranked slots 5' and the slider 7 is slid along the full length of the cranked slots 5', the binding cord twisting mechanism 15 is further rotated, accordingly, the binding cords 2*a* and 2*b* captured by the hooks 17 at the lower end of the twisting mechanism 15 are twisted together several times around the bag opening 28. This twisting action is stopped when the cords reach the innermost ends of the obliquely cranked slots 5'. The bag opening 28 is then guided into a drawing-out hole 6 formed at the lower end of the cranked slots 5'.

After the above operation, the pulling force to the finger pieces 8 is released so as to move the slider 7 back to the original position by the force of the spring 9. With the downward movement of the slider 7, the gear 13 of the delivery rollers 12 is rotated as disclosed above by the rotation of the pinion 14 engaged with the feeding rack 11. (In this case, the gear 13 is rotated only when the slider 7 is moved downward, while it becomes idle in the upward movement of the slider 7 The binding cord 2 supported between the delivery rollers 12 is thus advanced by a certain length for the next step. When the pinion 14 reaches the end of the feeding rack 11, the action cam 21 raises the lifting cam piece 22 so that the cutting blade 23 interlocked with the cam piece 22 is also raised. Therefore, the delivered binding cord 2 is cut at a certain length, and the cut piece of the binding cord 2 bridges the bag-opening guide slots 5 for the next binding operation.

Meanwhile, the bound bag opening 28 received within the drawing-out hole 6 in the foregoing step, is easily moved by pulling it from one side of the side wall 1. Further, the numeral 33 in the drawing indicates a guide slot for the bag opening 28. This guide slot 33 is formed in the middle portion of the slider 7 and is provided with an open space 33' just below the hooks 17 of the binding cord twisting mechanism 15.

As disclosed above, the slider that can be moved back and forth is provided in the space between the pair of side walls, and the finger pieces formed on the front edge of the slider fit the obliquely cranked slots of the L-shaped guide slots. Further, the slider is interlocked with the binding cord twisting mechanism, delivery rollers and binding cord cutting blade so that, only by inserting a bag opening to be bound into the bag-opening guide slots and pushing it along the L-shaped obliquely cranked slots will the slider move downward between the two side walls integrally with the bag opening, and the ends of the binding cord that is introduced into the guide slots are automatically twisted together by several rotations of the binding cord twisting mechanism. Furthermore, with the downward movement of the slider, the feeding and cutting of the binding cord of a certain length can be automatically performed for the use of the next step. Therefore, the handling of the binding device is very easy; in addition, the device is simple in structure so that the binding device of the invention can be free from the occurrences of erroneous action, troubles and damages. Still further, the obliquely cranked slots of the L-shaped guide slots are inclined downward, so that the sliding motion of the slider that is fitted near the cranked slots can be performed smoothly with a minimum force. Therefore, the binding device of the present invention is of great utility and advantage.

Although the present invention has been described in connection with a preferred embodiment thereof, many variations and modifications will now become apparent to those skilled in the art. It is preferred, therefore, that the present invention be limited not by the specific disclosure, but only by the appended claims.

We claim:

1. A binding device for twist-tying a bag opening with a wire-like binding cord, said device comprising:

a pair of spaced vertical sidewalls, said sidewalls having first L-shaped guide slots wide enough to receive said bag opening therein in the top sides thereof, the lower ends of said slots extending obliquely from the vertical portion of said L-shape, binding cord supply means between said vertical walls for supplying binding cord to close said bag opening;

binding cord delivery means attached to the top side of said vertical walls between said walls and beside said first guide slots for delivering and cutting a predetermined length of binding cord from said binding cord supply means across said first guide slot;

a slider adjacent said first guide slot between said vertical walls and movable in response to the movement of said bag in said first guide slot;

binding cord twisting means on said slider and positioned adjacent said obliquely extending portion of said first guide slot for contacting and twisting said binding cord about said bag opening in said first guide slot during movement of said slider with said bag therein; and a rack and action cam means at the front portion of said slider and connected to said binding cord delivery means in conjunction with the movement of said slider to feed and cut a binding cord, whereby when the open end of said bag is inserted into said first guide slot and moved therealong, a length of binding cord is twisted therearound by said binding cord twisting means moved in cooperation with the movement of said slider.

2. A binding device as claimed in claim 1 wherein said vertical side walls have second guide slots at one end thereof angled down from the vertical, and said binding cord supply means is fitted into said second guide slots.

3. A bind device as claimed in claim 1, wherein said binding cord twisting means is comprised of:

a rotatable shaft;

hook means on opposite sides of said shaft for engaging said binding cord;

a gear on said shaft; and a stationary rack engaging said gear and positioned on the inside of said vertical walls, whereby moving said slider causes said gear to run along said rack and causes said shaft to rotate.

* * * * *